US005298830A

United States Patent [19]

Branovich et al.

[11] Patent Number: 5,298,830

[45] Date of Patent: Mar. 29, 1994

[54] METHOD OF PREPARING AN IMPREGNATED CATHODE WITH AN ENHANCED THERMIONIC EMISSION FROM A POROUS BILLET AND CATHODE SO PREPARED

[75] Inventors: Louis E. Branovich, Howell; Donald W. Eckart, Wall, both of N.J.

[73] Assignee: The United States of America as represented by the Secretary of the Army, Washington, D.C.

[21] Appl. No.: 866,773

[22] Filed: Apr. 3, 1992

[51] Int. Cl.[5] ..... H01J 1/14

[52] U.S. Cl. ..... 313/346 R; 313/346 DC

[58] Field of Search ..... 313/346 R, 346 DC

[56] References Cited

U.S. PATENT DOCUMENTS 4,783,613 11/1988 Yamamoto et al. ..... 313/346 R
4,924,137 5/1990 Watanabe et al. ..... 313/346 R
5,118,984 6/1992 Saito et al. ..... 313/346 R

*Primary Examiner*—Donald J. Yusko
*Assistant Examiner*—Matthew Esserman
*Attorney, Agent, or Firm*—Michael Zelenka; Roy E. Gordon

[57] ABSTRACT

A method is provided of preparing an impregnated cathode with enhanced thermionic emission from a porous billet by impregnating the billet with a suitable impregnant in the presence of an oxygen deficient compound.

4 Claims, No Drawings

METHOD OF PREPARING AN IMPREGNATED CATHODE WITH AN ENHANCED THERMIONIC EMISSION FROM A POROUS BILLET AND CATHODE SO PREPARED

GOVERNMENT INTEREST

The invention described herein may be manufactured, used, and licensed by or for the Government for governmental purposes without the payment to us of any royalty thereon.

FIELD OF INVENTION

This invention relates in general to a method of preparing an impregnated cathode with enhanced thermionic emission from a porous billet and to a cathode so prepared and in particular to such a method wherein the impregnation is made in the presence of an oxygen deficient compound.

BACKGROUND OF THE INVENTION

Heretofore it has been known that electron emission could be obtained from a porous billet as for example a porous tungsten billet that had been impregnated with a barium containing compound such as $Ba_3Al_2O_6$. The $Ba_3Al_2O_6$ impregnant reacts with the wall of the porous tungsten billet generating free barium. The free barium then migrates to the surface by Knudsen flow to give electron emission.

The difficulty with this concept is that there is no mechanism for the generation of electrons. The concept of barium migrating to the surface to give off electrons is too generalized in that if 15–20 mg of barium containing compound gave free barium that was responsible for electron emission, the cathode would cease to give emission within minutes.

SUMMARY OF THE INVENTION

The general object of this invention is to provide a method of making a cathode having a more enhanced emission.

It has now been found that the foregoing object can be attained by impregnating a porous billet in the presence of an oxygen deficient compound. Such a compound that is similar in structure to superconductor deficient oxides would then generate electrons.

The oxygen deficient compound can be considered as a compound in which a site is available for an oxygen atom but the site is not occupied by an oxygen atom. When the oxygen site is unoccupied, the valence of the remaining metals drops to a lower valence state.

The oxygen deficient compounds used in the invention include $SCWO_4$, $AlWO_4$, $MoO_2$, $WO_2$ and mixed oxides of rhenium and iridium.

In the method of the invention, regeneration of the impregnant must occur for the cathodes to have a long life of 80,000 to 200,000 hours. Then too, oxygen deficient compounds must either be present in the cathode or must be generated in the cathode. The oxygen deficient compounds that are generated or present react once they have acquired negative charge by the method used above, with Ba and/or BaO to form oxygen sufficient compounds with the release of electrons that are responsible for electron emission. Additives such as Ir, Os, and Rh react in such a way as to increase emission by reacting to generate oxygen deficient compounds such as $WO_2$. Moreover, intermediate oxygen sufficient products formed in the chemical reactions can be used as impregnants providing they generate oxygen deficient compounds.

A method of regeneration of the impregnant is illustrated using $Ba_2Al_2O_6$ to form an intermediate that reacts to form $WO_2$ and releases free Ba leaving an unstable intermediate (oxygen deficient) $Ba_2Al_2O_4$. This compound in the presence of 2W reacts to form 2 Al +2 $WO_2$ +2 Ba. When these compounds that are generated are added to the above free Ba and $WO_2$ the total becomes 2 Al +3 $WO_3$+3 Ba and the overall equation becomes $$Ba_3Al_2O_6+3\ W \rightarrow 3\ Ba+2\ Al+3\ WO_2$$

The 3 Ba+2 Al +3 $WO_2$ reacts with each other to form $Ba_3Al_2O_6$+3 W that are the original starting compounds. The equations for this are illustrated below $$Ba_3Al_2O_6+W \rightarrow Ba+WO_2+Ba_2Al_2O_4$$

$$Ba_2Al_2O_4+2\ W \rightarrow 2\ Ba+2\ Al+2\ WO_2$$

Combining the two equations above gives $$Ba_3Al_2O_6+3\ W \rightarrow 3\ Ba+2\ Al+3\ WO_2$$

The compounds that were formed from a series of steps convert back to the impregnant and W again.

This regeneration scheme is ideally illustrated. The formation of $WO_2$ (not illustrated) in the above scheme occurs when a $WO_2$ attacks the impregnant $Ba_3Al_2O_6$ to remove one oxygen to form $WO_3$ and a $Ba_3Al_2O_5$ Molecule that is oxygen deficient. The $WO_3$ can react with the Al generated to give $Al_2(WO_4)_3$ which in the presence of W gives $AlWO_4$ and $WO_2$.

The reactions are shown by chemical equations $3Ba_3Al_2O_6 + W \rightarrow 3Ba_3Al_2O_5 + WO_3$ The $Ba_3Al_2O_5$ generated is oxygen deficient; two electrons are now present where the sixth oxygen was present in the $Ba_3Al_2O_6$ structure.

The $WO_3$ formed f rom above can react with the Al generated previously to give $WO_2$ and $AlWO_4$;4 $WO_3+2Al \rightarrow 2\ WO_2+AlWO_4$. The $WO_2$ and $AlWO_4$ are both oxygen deficient compounds.

The impregnants used for the porous billet must be of the type $A_xB_yO_z$ where A is a very electro positive metal (more active than B). B is a metal that converts over to its most stable oxide in the presence of tungsten (W) or other active billet material such as molybdenum. The 0 is oxygen in the above formula. The subscript Z must be such that the valence of A times its subscript is equal to subscript of the oxygen (z) divided by the absolute value of the valence of oxygen (2). The value of the subscript on the oxygen (z) can be one less than this amount if one of the oxygen's are replaced with a pair of electrons. An example would be $Ba_3Al_2O_6$ and $Ba_3Al_2O_5$ (1 pair of electrons is substituted for the oxygen that is attached to the aluminum).

The A which is more active than B attacks the B oxide and converts it to a pure metal and the A in turn converts to its stable oxide.

The active B in the presence of W03 reacts to form two oxygen deficient compounds $B_yWO_4$ (where Y $=+1$) and $WO_2$ in a W billet. When the Ba and BaO generated previously react with the oxygen deficient materials to form oxygen sufficient materials such as $BaWO_4$ along with Al f or example, the materials generated are recycled into the regeneration process to continue the process of electron emission.

Various other methods of generation of oxygen deficient compounds in cathodes have been demonstrated.

Reaction of an oxygen sufficient tungstate or molybdate of B (such as Al or Sc) with W. An example is $$2\,W + Al_2(WO_4)_3 \rightarrow 2AlWO_4 + WO_2$$

Another illustration of formation of an oxygen deficient compound is through the reaction of B oxides, B metal and $WO_3$ such as $Al_2O_3 + 5Al + 9WO_3 \rightarrow 7AlWO_4 + WO_2 + W$ Another illustration is the B stable oxide (Al2O3 for example) with $WO_3$ and $WO_2$ as shown $Al_2O_3 + WO_2 + WO_3 \rightarrow 2AlWO_4$ Another illustration is $Al_2(WO_4)_3 + Al \rightarrow 3AlWO_4$ $A_xB_yO_z$ compounds must be able to form the oxygen deficient compounds and then convert to oxygen sufficient compounds which are capable of joining the regeneration cycle.

Since products such as oxygen deficient compounds such as $WO_2$, $SCWO_4$, $MoO_2$ are formed for example as well as other intermediate products such as free Al, free Sc, oxides such as $SC_2O_3$, $Al_2O_3$ and $WO_3$ that help in the formation of oxygen deficient compounds, they can be added in molar ratios such that the combination with Ba and BaO will contribute to low temperatures operation and fast warm-ups for cathodes.

Application of pulverized pieces of alloys such as low melting $Al_5$ $Ba_4$ in molar ratio suitable for maximum emission with materials listed above gives maximum emission.

A W or W-Al alloy can be used for the porous billet. W-Ir, W-Os etc can also be used as the porous billet.

In lieu of an impregnated porous billet by itself, one may employ a top layering emission.

A top layering emission includes two separate electron generators; the impregnanted billet itself, and the top layered material. The current density is a sum of both generators.

Both Ba and BaO that are generated in the billet below the top layered billet migrate to the layered top to form intermediates and oxygen deficient compounds similar to those produced in the porous billet. The Ba and BaO that usually escapes from the billet is now used by the top layered portion of this billet.

To initiate top-layering reactions, formation of compounds such as $SC_2(WO_4)_3$, or their presence initially in or on a portion of the top layer must be present. Also present must be W such that $SC_2(WO_4)3 + W \rightarrow 2SCWO_4 + 2\,WO_2$. Both products are oxygen deficient and in the presence of Ba and BaO react to form oxygen sufficient compounds and electrons.

Scandium metal, for example, that can be generated when Ba reacts with $SC_2(WO_4)_3$ can participate in the reaction by reacting with $SC_2(WO_4)_3$ to form $SCWO_4$, an oxygen deficient compound.

Oxygen deficient compounds such as $SCWO_4$ and $WO_2$ must be present initially or must be formed for emission to occur. Some preparation of top-layering could include mixtures of [$Sc_2O_3/WO_3/W$], [$Sc_2(WO_4)_3/W$], [$Sc_2(WO_4)_3/ScWO_4/W/WO_3$]for example. Only mixtures that give oxygen deficient compounds can be considered for top-layering.

Both Ba and BaO must enter the top layering to obtain maximum emission. $AlWO_4$,for example needs Ba, $WO_2$ needs BaO for maximum emission generating electrons.

When oxygen deficient $WO_2$ reacts with 2 BaO, Ba is generated. This makes for better emission because the Ba is generated within the top layer and does not have to be generated within the porous billet. Possibility of a Bao generator at the bottom of an enriched $WO_2$ layer to give high emission can be made.

Al and $WO_3$ mixtures have been demonstrated to give oxygen deficient compounds $AlWO_4$ and $WO_2$. Mixtures of Al and $WO_2$ can be used in top-layering in the presence of tungsten.

DESCRIPTION OF THE PREFERRED EMBODIMENT

Since the emission of the impregnated cathodes involve the formation of oxygen deficient compounds, a method to maximize emission can be obtained by (1) Adding the oxygen deficient compounds to the impregnant; (2) Adding compounds such as $Al_2(WO_4)_3$ or $Sc_2(WO_4)_3$ which in the presence of W react to form $WO_2$ and $AlWO_4$ or $SCWO_4$ which are oxygen deficient compounds or (3) Adding composites of 1 and 2 above. Examples are illustrated below.

EXAMPLE 1

The example below illustrates the use of intermediate compounds that are formed on the surface and interior of the cathode during operation. Use of intermediates such as $WO_3$, $Al_2O_3$ and alloys such as $Al_{13}Ba_7$ to initiate the chemical reaction at temperatures lower than that when only the impregnant such as $Ba_3Al_2O_6$ is present.

$Ba_3Al_2O_6$, $WO_3$, $Al_2O_3$, and $Al_{13}Ba_7$ alloy are mixed in such a way that the molar combinations are 2 mole $Ba_3Al_2O_6$, mole $WO_3$, 1 mole $Al_2O_3$ and 0.05 to 0.20 moles of $Al_{13}Ba_7$. This mixture is crushed and then ball milled for two hours. Twenty to forty milligrams of the above molar mixture is mixed with 200 to 300 mgs of tungsten powder. The mixture is ball milled and placed into an isostatic compressor with 60,000 lb/in$^2$into a billet. Xray and Auger Spectroscopy tests are run on the billet to determine the distribution of the powder mixture throughout the billet. Sintering the billet at 700° C. for 10 minutes in hydrogen, vacuum or inert gas such as argon prepares the billet for a cathode environment.

EXAMPLE 2

Another example illustrated below uses the standard impregnant $Ba_3Al_2O_6$ with oxygen deficient compounds such as $WO_2$ and $AlWO_4$.

$Ba_3Al_2O_6$, $WO_2$, $AlWO_4$ and an alloy of aluminum and barium such as $Al_{13}Ba_7$ are mixed in such a way that the molar combination is 2 moles $Ba_3Al_2O_6$, 1 mole $WO_2$, 1 mole $AlWO_4$ and 0.05 to 0.2 mole $Al_{13}Ba_7$. The mixture is ball milled for two hours and then a mixture of 200 to 300 mg of tungsten powder is mixed with 20 to 40 mg of the above molar combination of $Ba_3Al_2O_6$, $WO_2$, $AlWO_4$ and $Al_{13}Ba_7$. The mixture is isostatically compacted into a billet, and Xray and Auger Spectroscopy test are done to determine the distribution of the powders through the billet. Sintering at 700° C. in $H_2$, vacuum, or an inert gas such as argon for 10 minutes prepares the billet for a cathode environment.

EXAMPLE 3

Other mixtures for impregnation would include mixtures of $Ba_3Al_2O_6$ and $Al_2(WO_4)_3$ in molar concentrations of 1 mole $Ba_3Al_2O_6$ and 1 mole of $Al_2(WO_4)_3$ with 0.05 to 0.1 mole $Al_{13}Ba_7$.

Sintering, mixing, and compacting of the above powder with W powder are similar to EXAMPLES I and 2.

EXAMPLE 4

The use of intermediates with barium scandates, and scandium intermediates can also be used as in a cathode impregnant.

Illustrations Are:

a. $Ba_2SC_2O_5$ with $WO_3$, $SC_2O_3$ such that the molar concentration is 2 moles $Ba_2Sc_2O_5$ with 1 mole $WO_3$ and 1 mole of $SC_2O_3$.

b. The $Ba_6Sc_6O_{15}/WO_3$ and $SC_2O_3$ such that the molar concentration is 2 moles $Ba_6SC_6O_{15}$, 2 moles $WO_3$, and 0.1 to 0.3 mole of $Sc_2O_3$.

c. The $Ba_3Sc_4O_9$ with $WO_3$ and $Sc_2O_3$ such that the molar concentration is 2 moles $Ba_3Sc_4O_9$, 1 mole $WO_3$ and 0.1 to 0.2 mole of $Sc_2O_3$.

Sintering mixing and compacting of the above powder with W powder are similar to examples 1 and 2 above.

EXAMPLE 5

The use of oxygen deficient compound such that $WO_2$ and $ScWO_4$ with the barium scandates illustration of example 4 is as follows:

1. $Ba_2Sc_2O_5$ with $WO_2$ and $ScWO_4$ such that the molar combinations are 1 mole $Ba_2Sc_2O_5$, mole $WO_2$ and 1 mole $ScWO_4$.

2. $Ba_6Sc_6O_{15}$ with $WO_2$ and $SCWO_4$ such that the molar concentration is 2 moles $Ba_6Sc_6O_{15}$, moles $WO_2$ and 0.1 to 0.3 mole of $ScWO_4$.

3. $Ba_3Sc_4O_9$ with $WO_2$ and $SCWO_4$ such that the molar combination is 1 mole $Ba_3Sc_4O_9$, mole $WO_2$ and 0. 1 to 0. 3 mole $SCWO_4$.

Sintering, mixing and compacting the above powders with W powder are similar to Examples 1 and 2.

EXAMPLE 6

This example involves all the mixtures found in Examples 1 through 5 but adding the mixtures to a tungsten cup of known volume and geometric size. Instead of isostatically compacting the mixtures, the mixtures can be solidified by CVD reactions of W from $W(CO)_6$ and the melting of aluminum. The intermediate is 0.05 mole $Al_2(WO_4)_3$, 0.5 mole of $Al_{13}B_7$ and 1 mole of W with 1 mole of $Ba_3Al_2O_6$.

We wish it to be understood that we do not desire to be limited to the exact details Of construction shown and described for obvious modifications will occur to a person skilled in the art.

What is claimed is:

1. A cathode having an enhanced thermionic emission including a porous billet and a sintered mixture of an impregnant with other compounds within such porous billet that react to form an oxygen deficient compound at least as one of their products, wherein the impregnnt is $Ba_3Al_2O_6$ and wherein the other compounds within the porous billet that react with the $Ba_3Al_2O_6$ impregnant are $Wo_3$, $Al_2O_3$ and $Al_{13}Ba_7$ alloy.

2. A cathode having an enhanced thermionic emission including a porous billet and a sintered mixture of an impregnant with other compounds within such porous billet that react to form an oxygen deficient compound at least as one of their products, wherein the compounds are mixed within the porous billet in the mole ratio of 2 moles $Ba_3Al_2O_6$ to 1 mole $WO_3$ to 1 mole $Al_2O_3$ to 0.05 to 0.20 mole of $Al_{13}Ba_7$ alloy.

3. A cathode having an enhanced thermionic emission including a porous billet and a sintered mixture of an impregnant and at least one oxygen deficient compound within the porous billet wherein the impregnant is $Ba_3Al_2O_6$ and the impregnant is mixed with the oxygen deficient compounds $WO_2$ and $AlWO_4$ and the alloy $Al_{13}Ba_7$.

4. A cathode having an enhanced thermionic emission including a porous billet and a sintered mixture of an impregnant and at least one oxygen deficient compound within the porous billet wherein the compounds are mixed in the ratio of 2 moles $Ba_3Al_2O_6$ to 1 mole $WO_2$ to 1 mole $AlWO_4$ to 0.05 to 0.2 moles of $Al_{13}Ba_7$ alloy.

* * * * *